US005192233A

United States Patent [19]

Suffredini et al.

[11] Patent Number: 5,192,233

[45] Date of Patent: Mar. 9, 1993

[54] GROUNDING BLOCK

[75] Inventors: Nino R. Suffredini, Monroe; James D. Anderson, Norwalk, both of Conn.

[73] Assignee: Burndy Corporation, Norwalk, Conn.

[21] Appl. No.: 817,713

[22] Filed: Jan. 7, 1992

[51] Int. Cl.[5] ..... H01R 11/09

[52] U.S. Cl. ..... 439/723; 439/936

[58] Field of Search ..... 439/723, 724, 283, 685, 439/695, 696, 607, 608, 936

[56] References Cited

U.S. PATENT DOCUMENTS

| | | | |
|---|---|---|---|
| 3,383,643 | 5/1968 | Nava et al. | 439/724 |
| 3,397,384 | 8/1968 | Lawrence | 439/723 |
| 3,471,822 | 10/1969 | van Baelen | 439/724 |
| 3,755,615 | 8/1973 | Paullus et al. | 439/936 |
| 3,877,772 | 4/1975 | De Cenzo | 439/724 |
| 3,970,352 | 7/1976 | Dorrell et al. | 439/936 |
| 4,580,863 | 4/1986 | Lohr et al. | 439/695 |
| 4,655,525 | 4/1987 | Hunt, III et al. | 439/695 |

*Primary Examiner*—Larry I. Schwartz
*Assistant Examiner*—Hien D. Vu
*Attorney, Agent, or Firm*—Perman & Green

[57] ABSTRACT

A grounding block electrical connector for use in electrically grounding a plurality of electrical wires. The block has a housing, electrical contacts, a busing plate, and a strain relief grommet. The housing has a contact receiving area for receiving the electrical contacts and a grommet receiving area. The electrial contacts are welded to the busing plate which is riveted to the housing such that the contacts are electrically connected to the housing. In addition, a protrusion of the busing plate from the housing provides a direct electrical contact to a member on which the connector is intended to be mounted. The grommet is fixedly connected to the housing at the grommet receiving area by a bonding adhesive.

10 Claims, 3 Drawing Sheets

GROUNDING BLOCK

BACKGROUND OF THE INVENTION

1. Field of the Invention

The present invention relates to grounding electrical devices and, more particularly, to a connector block used to ground a plurality of electrical devices.

2. Prior Art

In various applications, such as an aircraft, it is necessary to provide or make a ground for a plurality of electrical devices, such as motors, pumps, electronic circuitry, etc. In the past, individual ground connections have been used for each of these electrical devices. Also in the past, a grounding connector has been used to allow a plurality of electrical devices to be connected to a frame or the like at one location.

It is an objective of the present invention to provide a new and improved connector for grounding that provides additional features over the prior art.

SUMMARY OF THE INVENTION

In accordance with one embodiment of the present invention, a grounding block is provided with a housing, contacts, a grommet, and means for fixedly connecting the grommet to the housing. The contacts are positioned in the contact receiving area. The grommet is comprised of a resilient polymer material located, at least partially, in the grommet receiving area. The grommet including holes therethrough and grooves on an exterior of the grommet. The means for fixedly connecting the grommet to the housing comprises a bonding adhesive located between portions between the housing in the grommet receiving area an portions of the exterior of the grommet and in the grooves.

In accordance with one method of the present invention, a method of manufacturing a grounding block is provided. The method includes steps of providing a housing having a contact receiving area; connecting rows of contacts to a busing plate; inserting spacers between adjacent rows of contacts; and inserting the rows of contacts and spacers into the housing contact receiving area and connecting the busing plate to the housing.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
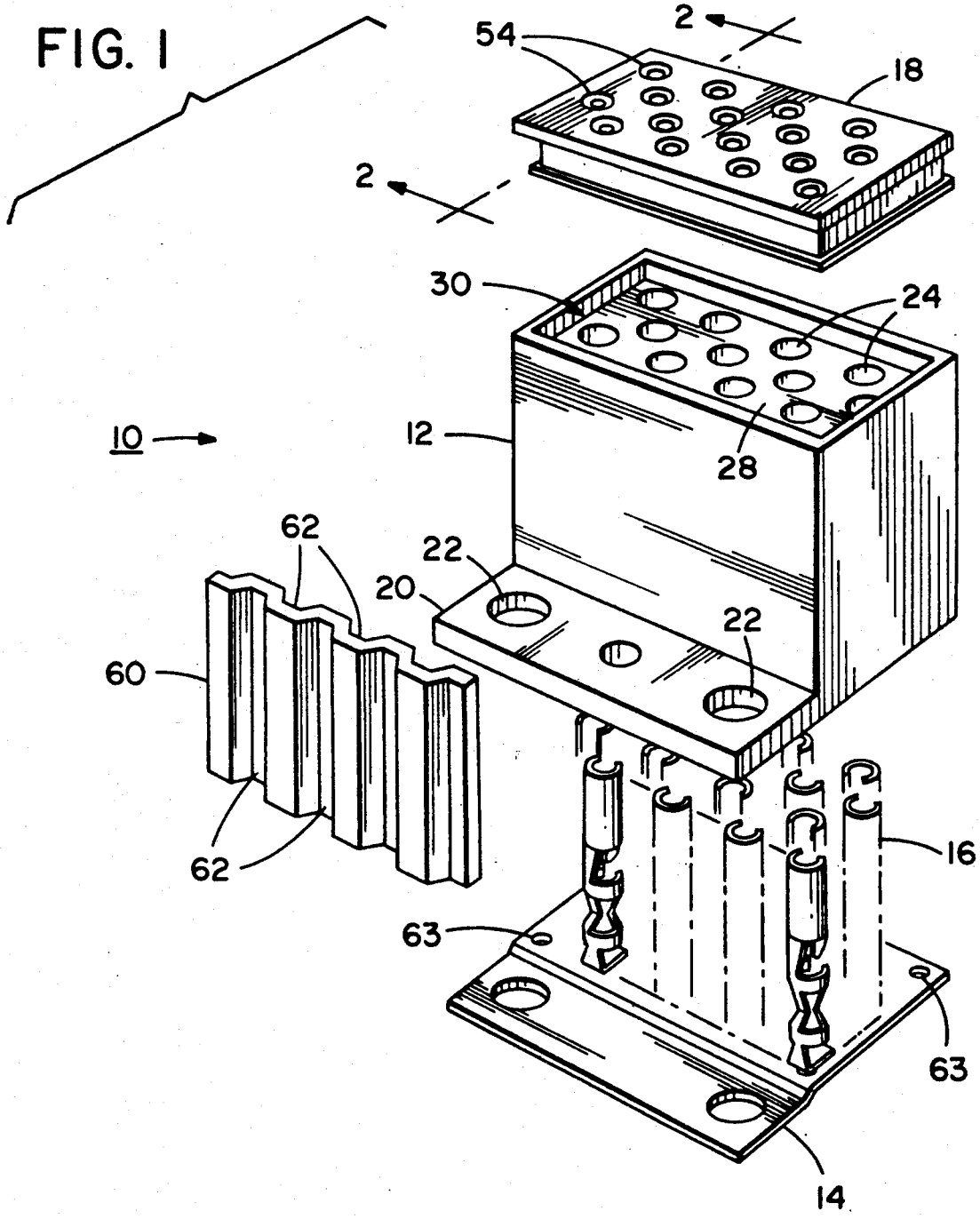
FIG. 1 is an exploded perspective view of a grounding block incorporating features of the present invention.

Referring to FIG. 1, there is shown an exploded perspective view of a grounding block or connector 10 incorporating features of the present invention. Although the present invention will be described with reference to the embodiment shown in the drawings, it should be understood that the present invention can be incorporated into various different types of embodiments. In addition, any suitable size, shape or type of elements or materials can be used to practice the claimed invention.

Figure 2:
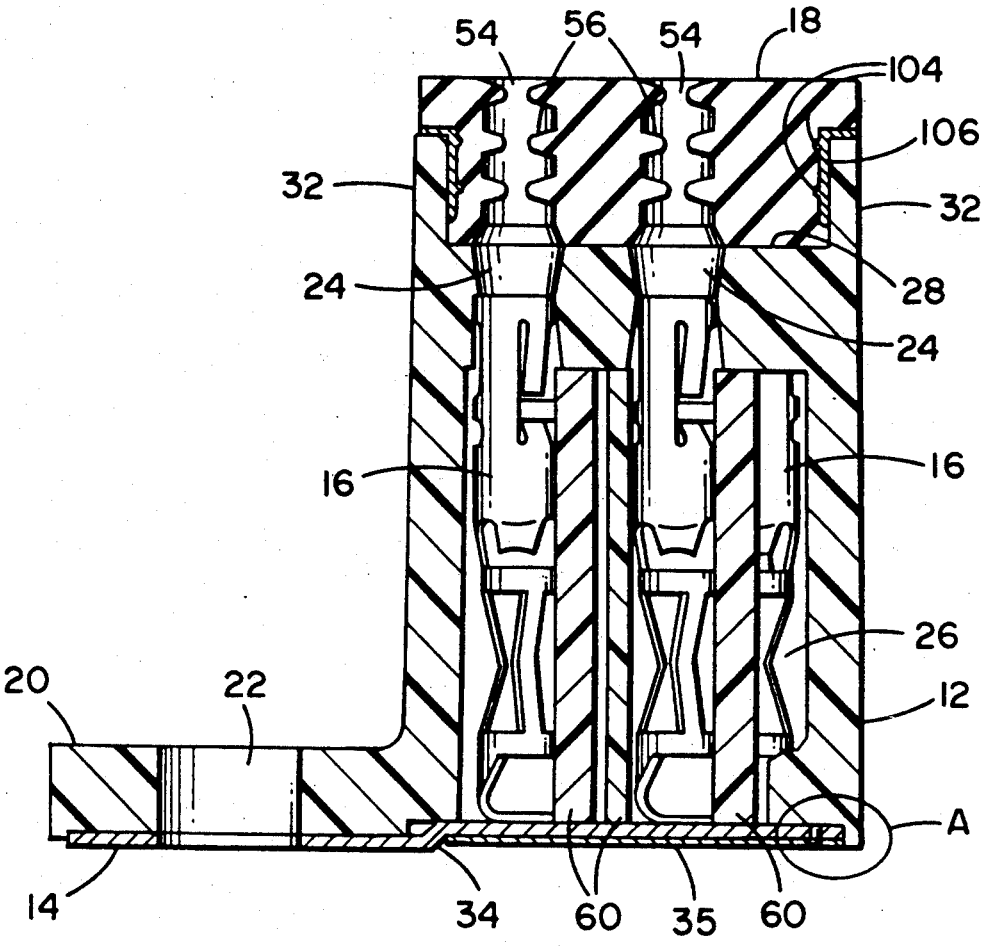
FIG. 2 is a cross-sectional view of the grounding block shown in FIG. 1 with spacers in place.

The grounding block 10 is generally comprised of a housing 12, a cover or busing plate 14, contacts 16 and a grommet 18. Referring also to FIG. 2, the housing 12 is generally comprised of an electrically conductive material such as metal. In a preferred embodiment, Aluminum is used which is die cast into the shape shown. The housing 12 has a ledge 20 with two holes 22 for mounting the housing to a member (not shown), such as the frame of an aircraft. The housing 12 also has a bottom aperture into a contact receiving area 26 and top holes or male contact receiving holes 24 extending from the area 26 to the top surface 28 of the housing, and a grommet receiving hole or area 30. In the embodiment shown, the housing 12 has sixteen holes 24 arranged in four rows of four, each row offset from an adjacent row. However, any suitable number or arrangement could be provided. As can be seen best in FIG. 2, the surface 28 forms the bottom of area 30. The housing 12 has outer perimeter walls or side walls 32 that also help to define area 30. Area 30 is substantially open for receiving a portion of the grommet 18 in the area 30.

Figure 2A:
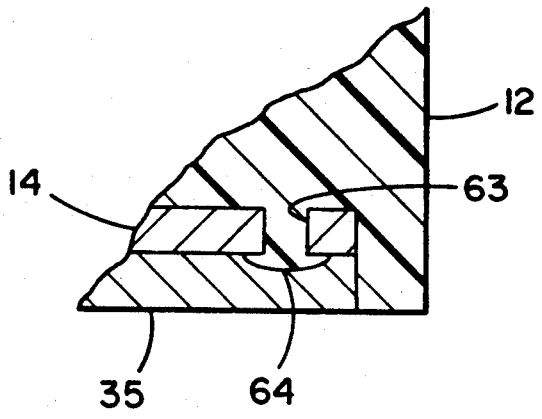
FIG. 2A is an enlarged view of area A shown in FIG. 2.

The busing plate 14, in the embodiment shown, is generally comprised of an electrically conductive material, such as metal, and has a general flat shape except for a step 34. The busing plate 14 is suitably sized and shaped to cover the bottom aperture into area 26 of the housing 12. Suitable means are provided to fixedly connect the busing plate 14 to the housing 12 such as by upset riveting the ends of small studs 64 which extend through holes 63 in busing plate 14 (see FIG. 2A). As shown in FIG. 2, the stepped portion of the busing plate 14 protrudes a small amount from the housing 12 on the assembled connector. Thus, when the mounting screws (not shown), through holes 22, are tightened, a direct electrical circuit path is provided to the member on which the connector is mounted. However, any suitable type of connection could be provided. The contact between the plate 14 and housing 12 also allows electricity to be transmitted therebetween. In the embodiment shown, the grounding block 10 also has a bottom pad 35 to fill in the void that would otherwise be present.

Figure 3:
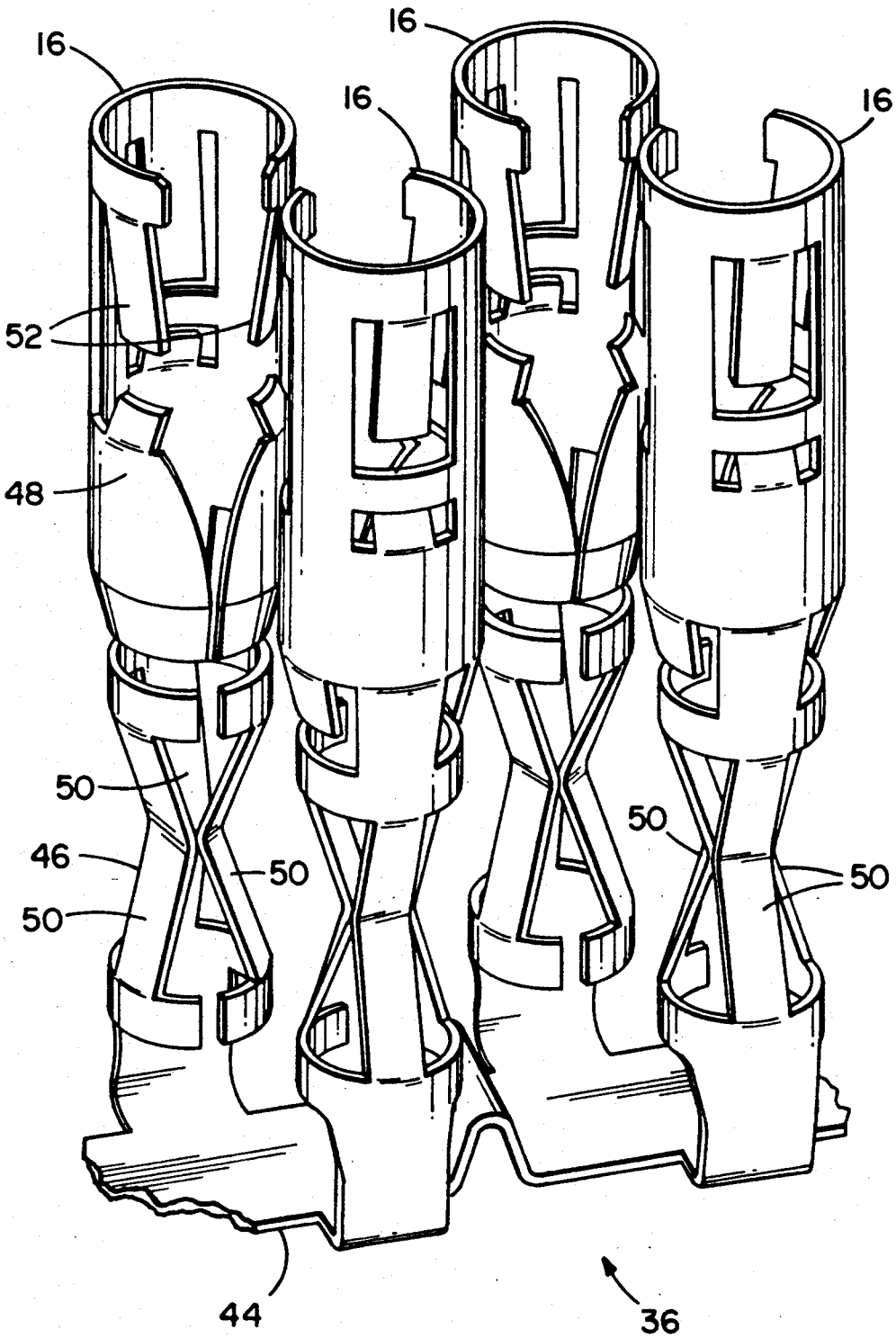
FIG. 3 is a partial perspective view of a row of contacts used in the grounding block shown in FIG. 1.

Referring also to FIG. 3, there is shown a partial perspective view of a strip 36 of contacts 16. In the embodiment shown, the grounding block 10 is adapted to receive sixteen male contacts (not shown) and thus has sixteen female contacts 16. For ease of assembly, the female contacts 16 are provided in two strips, each strip having a common member 44 and two rows of offset contacts 16, each row having four contacts 16 each. However, the contacts 16 could be provided in any suitable grouping or as singular members. In the embodiment shown, the strips of contacts 16 are comprised of a single electrically conductive member that is cut and shaped to provide the strip of contacts as a single member. In the embodiment shown, each contact 16 has a bottom section 46 and a top section 48. The bottom section 46 is connected to the common member 44 and has three inwardly bent contact arms 50 that are adapted to capture a portion of a male contact and make electrical contact therewith. The top section 48 has arms 52 to lock behind a portion of the male contact and prevent the male contact from being removed therefrom, except by use of an appropriate extraction tool.

The common members 44 are electrically connected to the busing plate 14 such that the contacts 16 are electrically connected to the housing 12. In a preferred embodiment, the strips 36 of contacts are fixedly connected to the busing plate 14 by spot welding the common members 44 to the plate 14. The bottom section 46 of each contact 16 is generally located in the area 26 of the housing 12. The top section 48 of each contact 16 is generally located in both the area 26 and one of its own holes 24.

The grommet 18 is generally comprised of a resilient polymer material and is suitably sized and shaped to be at least partially received in the receiving areas 30. In the embodiment shown, the grommet 18 has sixteen strain relief holes 54. Each hole 54 has strain relief rings 56. The holes 54 are suitably arranged and orientated to be aligned with the contact receiving holes 24 of the housing 12. The grommet 18 is generally provided as a strain relief for wires (not shown) connected to the male contacts (not shown) inserted into the grounding block 10. The strain relief rings 56, due to the resilient nature of the grommet, can elastically deform when the male contacts (not shown) are inserted into the connector 10 and, can close around the electrical wires connected to the male contacts to relieve strain by pulls on the wires.

A can be seen best in FIG. 2, the grommet 18 has grooves 104 along its exterior. A bonding adhesive 106 is located between the side walls 32 of the receiving area 30 and the grommet exterior in the receiving area, including in the grooves 104. The use of the grooves 104 allows more bonding adhesive to be located between the grommet 18 and housing 12 and thus, provides a stronger bond between the members.

In the embodiment shown, the grounding connector 10 also comprises three spacers 60. However, any suitable number of spacers can be provided. In the embodiment shown, the spacers 60 are comprised of plastic or a polymer material and have a general planar corrugated shape. The spacers 60 are located between adjacent rows of contacts 16. The spacers are generally provided to assist in the proper insertion and alignment of the contacts 16 into their corresponding holes 24. The plastic used for the spacers 60 is lightweight. Thus, this lightweight material assists in making the block 10 lightweight. This can be especially important if the block 10 is intended to be used in an aircraft. With the spacers 60 located between adjacent rows of contacts, the spacers locate and stabilize the contacts 16 for a relatively fast and accurate location of the contacts 16 in the receiving area 26 and holes 24. The general corrugated shape of the spacers help to provide greater support for the contacts 16 with a contact 16 being at least partially received in one of the recesses 62 that the spacers 60 have on each side.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A grounding block comprising:

a housing having a contact receiving area for receiving contact and a grommet receiving area for receiving at least a portion of a grommet;

contacts positioned in the contact receiving area;

a contact alignment spacer located between the contacts inside the housing in the contact receiving area, the spacer having a substantially planar corrugated shape;

a grommet comprising of a resilient polymer material located, at least partially, in the grommet receiving area, the grommet including holes therethrough and grooves on an exterior of the grommet; and means for fixedly connecting the grommet to the housing comprising a bonding adhesive located between portions of the housing in the grommet receiving area and portions of the exterior of the grommet and in the grooves.

2. A grounding block as in claim 1 further comprising an electrically conductive housing plate connected to the housing and contacts.

3. A grounding block as in claim 1 wherein the contact alignment spacer has recesses for portions of the contacts to be located.

4. A grounding block as in claim 1 wherein the contacts are comprised of rows of parallel contacts.

5. A grounding block as in claim 1 wherein the spacer is comprised of plastic and the housing is comprised of electrically conductive material.

6. A grounding block as in claim 1 wherein the housing has means for mounting the housing to another member.

7. A method of manufacturing a grounding block comprising the steps of:

providing a housing having a contact receiving area;

connecting rows of contacts to an electrically conductive busing plate;

inserting spacers between adjacent rows of contacts, the spacers having a substantially planar corrugated shape; and inserting the rows of contacts and spacers into the housing contact receiving area and connecting the busing plate to the housing.

8. A method as in claim 7 further comprising the steps of providing a grommet and connecting the grommet to the housing.

9. A method as in claim 8 wherein the step of connecting the grommet to the housing comprises the grommet having grooves on an exterior side thereof and bonding the grommet to the housing by use of bonding adhesive located between portions of the housing in the grommet receiving area and portions of the exterior of the grommet and in the grooves.

10. A method as in claim 7 wherein the busing plate is suitably connected to the housing such that a portion of the electrically conductive busing plate protrudes from the housing whereby a direct electrical contact can be made between the busing plate and a member onto which the grounding block is mounted.

* * * * *